US009964350B2

(12) United States Patent
Rees et al.

(10) Patent No.: US 9,964,350 B2
(45) Date of Patent: May 8, 2018

(54) CONTROL SYSTEM FOR A REFRIGERATED MERCHANDISER

(75) Inventors: Brian J. Rees, Auckland (NZ); Simon A. Johnston, Tauranga (NZ); Derek R. Lea, Paisley (GB)

(73) Assignee: Hussmann Corporation, Bridgeton, MO (US)

( * ) Notice: Subject to any disclaimer, the term of this patent is extended or adjusted under 35 U.S.C. 154(b) by 1653 days.

(21) Appl. No.: 13/494,310

(22) Filed: Jun. 12, 2012

(65) Prior Publication Data

US 2013/0327070 A1 Dec. 12, 2013

(51) Int. Cl.

| | |
|---|---|
| ***F25D 21/02*** | (2006.01) |
| ***F25D 21/06*** | (2006.01) |
| ***F25D 21/00*** | (2006.01) |
| ***F25D 29/00*** | (2006.01) |
| ***F25D 21/04*** | (2006.01) |
| ***A47F 3/04*** | (2006.01) |
| ***F25D 23/02*** | (2006.01) |

(52) U.S. Cl.

CPC ..... *F25D 21/04* (2013.01); *A47F 3/0447* (2013.01); *A47F 3/0478* (2013.01); *F25D 23/023* (2013.01); *F25D 2700/12* (2013.01)

(58) Field of Classification Search

CPC ..... A47F 3/0447; A47F 3/0478; A47F 3/04; F25D 21/04

USPC ..... 62/128, 140, 150, 151, 162, 234

See application file for complete search history.

(56) References Cited

U.S. PATENT DOCUMENTS

| | | | |
|---|---|---|---|
| 4,879,881 | A | 11/1989 | Madigan |
| 5,345,778 | A | 9/1994 | Roberts |
| 5,669,222 | A | 9/1997 | Jaster et al. |

(Continued)

FOREIGN PATENT DOCUMENTS

| | | |
|---|---|---|
| EP | 0637724 B1 | 10/1999 |
| JP | 05087422 | 4/1993 |

(Continued)

OTHER PUBLICATIONS

PCT/US2013/042577 International Search Report and Written Opinion dated Aug. 28, 2013 (12 pages).

(Continued)

*Primary Examiner* — Henry Crenshaw

(74) *Attorney, Agent, or Firm* — Michael Best & Friedrich LLP

(57) ABSTRACT

A refrigerated merchandiser including a case defining a product display area supporting product and an evaporator disposed in an air passageway in fluid communication with the product display area via an outlet to direct a refrigerated airflow into the product display area. The merchandiser also includes a control system in communication with and programmed to control the refrigeration system so that the product display area is maintained within a predetermined temperature range. The control system also varies the temperature of the refrigerated airflow through the outlet above an airflow temperature threshold between about 35 degrees Fahrenheit and 41 degrees Fahrenheit at least once during a predetermined time period to avoid formation of frost on the evaporator while maintaining the product display area within the predetermined temperature range.

7 Claims, 2 Drawing Sheets

(56) References Cited

U.S. PATENT DOCUMENTS

| | | | | |
|---|---|---|---|---|
| 5,713,213 | A * | 2/1998 | Nobuta | B60H 1/3225 62/126 |
| 6,912,864 | B2 | 7/2005 | Roche et al. | |
| 7,451,607 | B2 | 11/2008 | Behr | |
| 7,895,845 | B2 | 3/2011 | Every et al. | |
| 2001/0042384 | A1* | 11/2001 | Chiang | F25B 41/043 62/246 |
| 2002/0162346 | A1* | 11/2002 | Chiang | A47F 3/0447 62/246 |
| 2004/0123613 | A1* | 7/2004 | Chiang | A47F 3/0443 62/246 |
| 2004/0249222 | A1 | 12/2004 | Zweig | |
| 2005/0076662 | A1* | 4/2005 | Roche | A47F 3/0447 62/246 |
| 2005/0138959 | A1 | 6/2005 | Howe et al. | |
| 2007/0006604 | A1 | 1/2007 | Behr | |
| 2008/0098761 | A1 | 5/2008 | Zangari et al. | |
| 2008/0250801 | A1* | 10/2008 | Lifson | F04B 49/225 62/216 |
| 2010/0119705 | A1 | 5/2010 | Roche et al. | |
| 2010/0242506 | A1 | 9/2010 | Daddis, Jr. et al. | |
| 2010/0316806 | A1 | 12/2010 | He et al. | |
| 2011/0041515 | A1 | 2/2011 | Fraim | |
| 2011/0265507 | A1 | 11/2011 | Zangari et al. | |

FOREIGN PATENT DOCUMENTS

| | | |
|---|---|---|
| WO | 8701010 | 2/1987 |
| WO | 2008007313 | 1/2008 |
| WO | 2010020536 | 2/2010 |

OTHER PUBLICATIONS

Huang et al., "Preparation and anti-frosting performance of superhydrophobic surface based on copper foil," International Journal of Thermal Sciences, Apr. 2011, vol. 50, Issue 4, pp. 432-439 (Abstract Only).

Wu et al., "Investigation of the possibility of frost release from a cold surface," Experimental Thermal and Fluid Science, May 2001, vol. 24, Issues 4-3, pp. 151-156 (Abstract Only).

* cited by examiner

CONTROL SYSTEM FOR A REFRIGERATED MERCHANDISER

BACKGROUND

The present invention relates to refrigerated merchandisers, and more particularly to a control system for refrigerated merchandisers.

Refrigerated merchandisers are used by grocers to store and display food items in a product display area that must be kept within a predetermined temperature range. These merchandisers generally include a case that is conditioned by a refrigeration system that has a compressor, a condenser, and at least one evaporator connected in series with each other. At low operating temperatures, frost often forms on the evaporator, especially near the air inlet to the heat exchanger. Such frost formation can damage the evaporator and necessitate relatively frequent and thorough defrost cycles.

Both open and closed merchandisers require regular defrost cycles to maintain the coil sufficiently free of ice build-up such that it can perform to its intended purpose and capacity. However, the defrost cycles add heat to the product display area, which shortens product shelf life and increases the refrigeration load needed to cool product to the desired temperature. It is common for existing medium temperature merchandisers to have four to eight defrost cycles within a 24 hour period. For existing low temperature merchandisers, it is common to have one to four defrost cycles within a 24 hour period.

SUMMARY

The invention provides, in one aspect, a refrigerated merchandiser including a case that defines a product display area and that has an air outlet and an air passageway in fluid communication with the product display area via the outlet to direct an airflow into the product display area to condition product supported in the product display area. The merchandiser also includes at least a portion of a refrigeration system that has an evaporator disposed in the case within the air passageway to refrigerate the airflow. A control system is in communication with and programmed to control the refrigeration system so that the product display area is maintained within a predetermined temperature range. The control system is further programmed to vary the temperature of the refrigerated airflow through the outlet above an airflow temperature threshold between about 35 degrees Fahrenheit and 41 degrees Fahrenheit at least once during a predetermined time period to avoid formation of frost on the evaporator while maintaining the product display area within the predetermined temperature range.

In another aspect, the invention provides a refrigerated merchandiser including a case that defines a product display area and that has an air outlet and an air passageway in fluid communication with the product display area via the outlet to direct an airflow into the product display area to condition product supported in the product display area. The merchandiser also includes at least a portion of a refrigeration system that has an evaporator disposed in the case within the air passageway to refrigerate the airflow, and a compressor that is in fluid communication with the evaporator. The evaporator has a coil with a hydrophobic coating. A control system is in communication with and programmed to control the evaporator within a predetermined evaporating temperature range to condition the product display area within a predetermined temperature range. The control system also is programmed to selectively cycle the compressor between an on state and an off state at least once during a predetermined time period to avoid formation of frost on the coil while maintaining the product display area within the predetermined temperature range.

In another aspect, the invention provides a method of controlling a refrigerated merchandiser that includes a case defining a product display area. The case has an air outlet and an air passageway in fluid communication with the product display area via the outlet to direct an airflow into the product display area. The method includes continuously operating an evaporator disposed in the merchandiser within a predetermined evaporating temperature range, refrigerating the airflow using the evaporator to condition the product display area within a predetermined temperature range, cycling a compressor between an on state and an off state to avoid formation of frost on the evaporator, and maintaining the temperature of product supported in the product display area within the predetermined product temperature range when the compressor is in the on state and in the off state.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
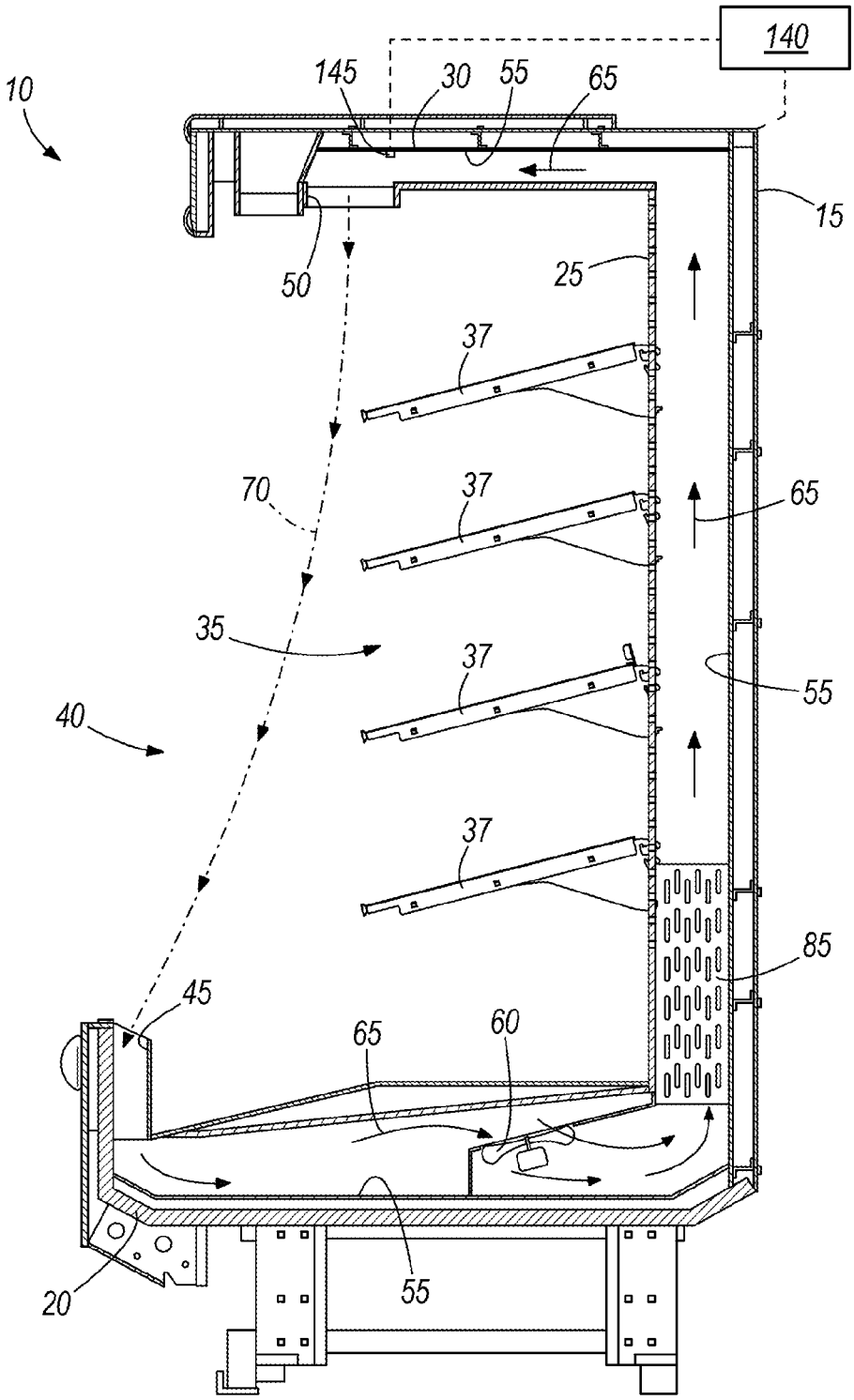
FIG. 1 is a section view of a refrigerated merchandiser embodying the present invention.

FIG. 1 shows one construction of a refrigerated merchandiser 10 that may be located in a supermarket or a convenience store or other retail setting (not shown) for presenting fresh food, beverages, and other food product (not shown) to consumers. The illustrated refrigerated merchandiser 10 includes a case 15 having a base 20, a rear wall 25, and a canopy 30. The area partially enclosed by the base 20, the rear wall 25, and the canopy 30 defines a product display area 35 that stores food product in the case 15 (e.g., on shelves 37) and that is accessible by customers through an opening 40 adjacent the front of the case 15. In the illustrated construction, the merchandiser 10 is a self-contained upright merchandiser with an open front. In some constructions, the merchandiser 10 may include one or more doors positioned over the opening 40 to provide access to the product display area 35. In other constructions, the merchandiser 10 can include a self-contained horizontal merchandiser with an open or enclosed top.

The illustrated base 20 is disposed substantially below the product display area 35 and can be supported by a floor or support surface (not shown) of the retail setting. The base 20 includes an air inlet 45 located adjacent a lower portion of the opening 40. The air inlet 45 is positioned to receive surrounding air from within and adjacent the product display area 35 in a substantially vertical direction to direct the surrounding air into the base 20.

The canopy 30 is disposed substantially above the product display area 40 and defines an upper portion of the product display area 40 that has an air outlet 50. The case 15 defines an air passageway 55 that provides fluid communication between the inlet 45 and the outlet 50. As illustrated, the air passageway 55 conducts air substantially horizontally through the base 20 from the inlet 45, substantially vertically along the rear wall 25, and substantially horizontally through the canopy 30 to the outlet 50. A fan 60 is coupled to the case 15 to generate an airflow (denoted by arrows 65) within the air passageway 55, although the fan 60 can be located anywhere within the air passageway 55. The outlet 50 is positioned to discharge the airflow 65 from the air passageway 55 into the product display area 40 adjacent the opening 40 in the form of an air curtain 70. As will be appreciated, the merchandiser 10 can include additional air curtains (not shown) depending on desired temperature(s) for the product supported in the product display area 35 and airflow characteristics of the merchandiser 10.

Figure 2:
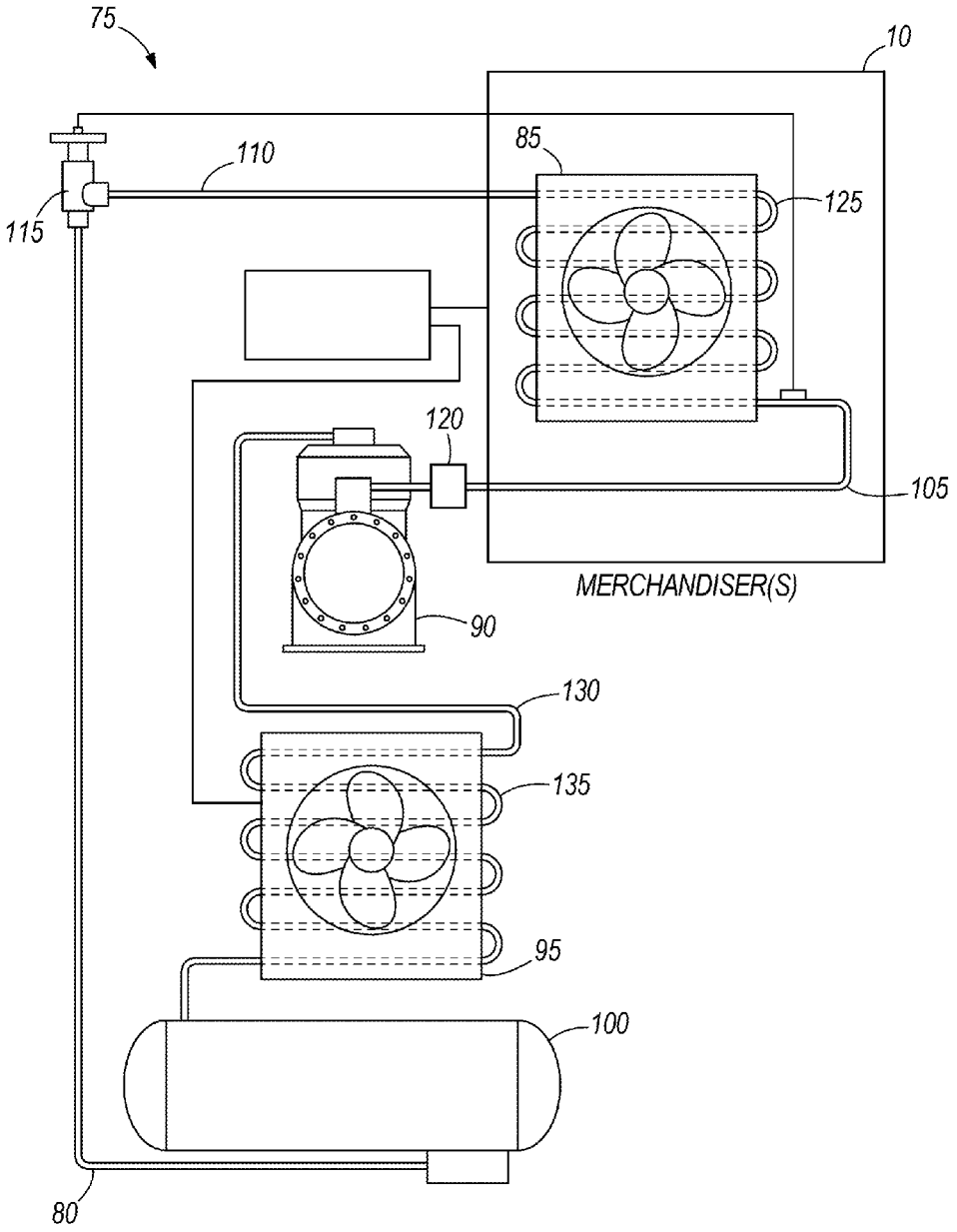
FIG. 2 is a schematic view of a refrigeration system for the refrigerated merchandiser of FIG. 1.

With reference to FIGS. 1 and 2, a refrigeration system 75 circulating a heat transfer fluid or refrigerant is in communication with the merchandiser 10 (or plural merchandisers 10) to refrigerate product supported in the product display area 35. In particular, the refrigeration system 75 includes a refrigeration circuit 80 that is defined by an evaporator 85, a compressor 90 (e.g., one compressor 90 or several compressors 90 in an assembly), a condenser 95, and a receiver 100. The evaporator 85 (e.g., microchannel or round tube plate-fin) is fluidly coupled with the compressor 90 via a suction line 105 to deliver evaporated refrigerant from the evaporator 85 to the compressor 90, and is fluidly coupled with the condenser 95 via an inlet line 110 to receive cooled, condensed refrigerant from the condenser 95. An expansion valve 115 is disposed in the inlet line 110 to create a pressure differential and to control the pressure of the refrigerant fluid delivered to the evaporator 85. The expansion valve 115 can include any valve configuration (e.g., thermostatic expansion valve 115, etc.). A second valve 120 (e.g., solenoid valve, etc.) is connected to the suction line 105 downstream of the evaporator 85 to control refrigerant flow from the evaporator 85 through the compressor 90 and within the refrigeration circuit 80 more generally.

The evaporator 85 is disposed in the passageway 55 and includes one or more coils 125 in heat exchange relationship with the refrigerant to refrigerate the airflow 65 within the passageway 55. The air curtain 70 generated by the airflow 65, among other things, helps to maintain the air temperature in the product display area 35 within a predetermined temperature range so that product can be maintained close to or at a desired temperature. For example, the illustrated merchandiser 10 is a medium temperature merchandiser (e.g., a reach-in refrigerated food merchandiser) in which the product display area 35 is maintained within a temperature range of approximately 32 degrees Fahrenheit to 41 degrees Fahrenheit. In other constructions, the merchandiser 10 can be a low temperature merchandiser (e.g., a reach-in frozen food merchandiser) in which the product display area 35 is maintained within a temperature range generally below 32 degrees Fahrenheit.

The evaporator 85 also includes a hydrophobic or superhydrophobic coating (e.g., ECRA-SH or ECRA-SHM, manufactured by ProMek Anti-Corrosion Australia Pty, with its business located at Unit 25, 17-21 Bowden Street, Alexandria NSW 2015, Australia) that is applied to the coil 125. Generally, the hydrophobic coating is thin and nonporous, and can be formed of a water-based, self-etching epoxy resin or other suitable materials. The hydrophobic coating acts as a barrier for the evaporator 85 to repel water from the coil 125 to minimize or prevent corrosion and frost from forming on the coil 125.

With reference to FIG. 2, a discharge line 130 fluidly connects the compressor 90 to the condenser 95 to direct refrigerant to the condenser 95 for cooling. The condenser 95 is coupled to the compressor 90 and the evaporator 85, and includes a series of looped conduits 135 to facilitate heat transfer between the refrigerant and the surrounding environment. Refrigerant in the evaporator 85 absorbs heat, decreasing the temperature of the airflow 65 passing over the evaporator 85. The heated or gaseous refrigerant then exits the evaporator 85 and is directed to the compressor 90. The refrigerated airflow 65 exiting the evaporator 85 is directed toward the product display area 35 via the passageway 55 and the outlet 50 to maintain product in the product display area 35 at desired conditions. The condenser 95 can be located on a rooftop or in other suitable areas of the retail setting to discharge heat energy to the surrounding atmosphere.

With reference to FIGS. 1 and 2, the merchandiser 10 and the refrigeration system 75 can be controlled by a control system 140, which evaluates the status of and controls the merchandiser 10 and/or the refrigeration system 75 and its components to maintain product display area 35 within the predetermined temperature range. The control system 140 can be located in any suitable location on, adjacent, or even remote from the merchandiser 10, and can be connected to one of more sensors (not shown) in the merchandiser 10 and/or the refrigeration system 75.

More specifically, the control system 140 selectively controls the merchandiser and the refrigeration components in response to the desired and/or sensed operating parameters. In some constructions, the control system 140 maintains the temperature of the product display area 35 within the predetermined temperature range based on a signal indicative of airflow temperature at the outlet 50 using a sensor 145 by adjusting operation of the refrigeration system 75 accordingly. Other signals indicative of the product display area temperature (e.g., evaporating temperature of the evaporator 85, environmental conditions surrounding the case 15, etc.) also can be used by the control system 140 to control the merchandiser 10 and the refrigeration system 75.

The control system 140 is in electrical communication with the evaporator 85, the compressor 90, the expansion valve 115, and the suction line valve 120 to control refrigerant flow and refrigerant temperatures within the refrigeration system 75. More specifically, the control system 140 is programmed to control refrigerant flow between the condenser 95 and the evaporator 85 via the expansion valve 115, which in part determines the evaporating temperature at which the evaporator 85 cools the airflow 65. For example, in the illustrated medium temperature merchandiser 10, the control system 140 controls the evaporator 85 within a predetermined evaporating temperature range between about 13 degrees Fahrenheit and 33 degrees Fahrenheit, although other evaporating temperature ranges are possible and considered herein.

The control system 140 also selectively cycles the compressor 90 between an on state in which refrigerant is compressed prior to being discharged to the condenser 95, and an off state in which refrigerant flows through the compressor 90 without being compressed. The control system 140 is further programmed to selectively cycle the suction line valve 120 between an open position and a closed position to control refrigerant flow from the evaporator 85 to the compressor 90. In the open position, the suction line valve 120 permits refrigerant flow from the evaporator 85 to the compressor 90. In the closed position, the suction line valve 120 inhibits refrigerant flow to the compressor 90.

In operation, the control system 140 controls the refrigeration system 75 so that the airflow 65 discharged through the outlet 50 is maintained at a first predetermined temperature set point so that the product display area 35 can be maintained within the predetermined temperature range. The first predetermined temperature set point can be a single temperature (e.g., 33 degrees Fahrenheit), or a range of temperatures (e.g., between 23 degrees Fahrenheit and 35 degrees Fahrenheit).

The control system 140 selectively increases the temperature of the refrigerated airflow 65 above a second predetermined temperature set point or airflow temperature threshold (e.g., above a temperature between about 35 degrees Fahrenheit and 41 degrees Fahrenheit) during normal operation of the merchandiser 10 (i.e., not during a defrost cycle) to avoid formation of frost on the evaporator 85 while still maintaining the product display area 35 within the predetermined temperature range. For example, the airflow temperature threshold can be approximately 37 degrees Fahrenheit, or another suitable temperature based on the desired cooling characteristics for the merchandiser 10.

More specifically, the control system 140 employs cyclic off-cycle control of the refrigeration system 75 to increase the airflow temperature above the airflow temperature threshold. Cyclic off-cycle control encompasses operating the evaporator 85 within the predetermined evaporating temperature range while selectively and cyclically varying the compressor 90 between the on state and the off state during a predetermined time period. Stated another way, the refrigerant equilibrates the evaporating temperature evenly within the predetermined evaporating temperature range during the off-cycle. The predetermined time period can be relatively short (e.g., 30 minutes, 1 hour, etc.) or relatively long (e.g., 12 hours, 24 hours, etc.).

The control system 140 also selectively employs suction stop control of the suction line valve 120 to balance the refrigerant evaporating temperature within the evaporator 85 while still maintaining the evaporating temperature within the predetermined evaporating temperature range. More specifically, the suction line valve 120 is closed when the compressor 90 is in the off state such that refrigerant downstream of the valve 120 will be essentially at a compressor operating suction pressure. Refrigerant pressure upstream of the valve 120 generally rises to a pressure that is approximately equal to the pressure temperature equivalent of return air flowing through the passageway 55. Moreover, use of a suction line valve 120 as opposed to other valves (e.g., a liquid line solenoid valve) minimizes cooling that can be caused by liquid refrigerant entering the evaporator 85 from the liquid line during the off state (i.e., the pump-down cooling effect associated with use of liquid line valves).

When control system 140 employs cyclic off-cycle control, the temperature of the airflow 65 goes above the airflow temperature threshold at some point, possibly only briefly, during the predetermined time period without increasing the temperature of the product display area 35 above the predetermined temperature range. Generally, the airflow temperature threshold is higher than the first predetermined temperature set point, although in circumstances where the first predetermined temperature set point encompasses a range of temperatures, the airflow temperature threshold can be a temperature near the higher end of that range.

For example, the control system 140 can cycle or adjust the temperature of the refrigerated airflow 65 above the airflow temperature threshold at least once, and two or more times if desired, during a predetermined time period to ensure that frost does not form on the evaporator coil 125. Cyclic frequency depends, for the most part, on the design parameters for the merchandiser 10 (e.g., type of merchandiser 10, evaporator coil size relative to the operating evaporating temperature, etc.). For example, cyclic off-cycle control can be employed between four times per predetermined time period (e.g., 1 hour) and twelve times per time period. Alternatively, cyclic off cycle control can be employed fewer than four times per predetermined time period or more than twelve times per time period.

The hydrophobic coating on the evaporator coil 125 and the control system 140 cooperate to provide a merchandiser that can be operated continuously or substantially without a defrost cycle. Stated another way, the control system 140 selectively cycles the compressor 90 between the on state and the off state one or more times during the predetermined period and balances the refrigerant temperature within the evaporator 85 to ensure no frost builds up on the coil 125 while maintaining the evaporating temperature within the predetermined evaporating temperature range and keeping the product display area within the predetermined temperature range over the entire predetermined time period. The control system 140 continuously operates the evaporator 85 within the predetermined evaporating temperature range for the entire predetermined time period regardless of whether the compressor 90 is in the on state or the off state. In this manner, the merchandiser 10 can be operated for significant periods of time (e.g., days, weeks) without a defrost cycle and without significant (if any) frost buildup on the coil 125.

Various features and advantages of the invention are set forth in the following claims.

The invention claimed is:

1. A refrigerated merchandiser comprising:

a case defining a product display area and including an air outlet and an air passageway in fluid communication with the product display area via the outlet to direct an airflow into the product display area to condition product supported in the product display area;

at least a portion of a refrigeration system including an evaporator disposed in the case within the air passageway to refrigerate the airflow; and a control system in communication with and programmed to control the refrigeration system in a normal mode so that the product display area is maintained within a predetermined temperature range, the control system further programmed to vary a temperature of the refrigerated airflow through the outlet above an airflow temperature threshold between about 35 degrees Fahrenheit and 41 degrees Fahrenheit at least once during a predetermined time period during the normal mode to avoid formation of frost on the evaporator while maintaining the product display area within the predetermined temperature range.

2. The refrigerated merchandiser of claim 1, wherein the control system is programmed to maintain the refrigerated airflow at the outlet at a predetermined temperature set point to keep the product display area within the predetermined temperature range, and wherein the airflow temperature threshold is above the predetermined temperature set point.

3. The refrigerated merchandiser of claim 2, wherein the airflow temperature threshold is approximately 37 degrees Fahrenheit.

4. The refrigerated merchandiser of claim 1, wherein the predetermined time period is approximately one hour.

5. The refrigerated merchandiser of claim 1, wherein the refrigeration system further includes a compressor and a condenser fluidly connected to the evaporator, and wherein the control system is in communication with the compressor to selectively cycle the compressor between an on state and an off state to vary the temperature of the refrigerated airflow discharged through the outlet above the airflow temperature threshold.

6. The refrigerated merchandiser of claim 5, wherein the refrigeration system further includes a valve connected to a suction line of the compressor, and wherein the control system is further programmed to selectively cycle the valve between an open position and a closed position when the compressor is in the off state to balance the temperature of refrigerant in the evaporator.

7. The refrigerated merchandiser of claim 5, wherein the control system is programmed to control the evaporator at an evaporating temperature between about 23 degrees Fahrenheit and 33 degrees Fahrenheit for the entire predetermined time period.

* * * * *